US011278935B2

(12) United States Patent
Alegre

(10) Patent No.: US 11,278,935 B2
(45) Date of Patent: Mar. 22, 2022

(54) CENTRIFUGAL SEPARATOR COMPRISING SPECIAL SEPARATOR WHEEL

(71) Applicant: NETZSCH-Feinmahltechnik GmbH, Selb (DE)

(72) Inventor: Sergio Alegre, L 'Hospitalet del Llobregat (ES)

(73) Assignee: NETZSCH-Feinmahltechnik GmbH, Selb (DE)

( * ) Notice: Subject to any disclaimer, the term of this patent is extended or adjusted under 35 U.S.C. 154(b) by 87 days.

(21) Appl. No.: 16/712,220

(22) Filed: Dec. 12, 2019

(65) Prior Publication Data

US 2020/0188959 A1 Jun. 18, 2020

(30) Foreign Application Priority Data

Dec. 13, 2018 (DE) ..... 102018132155.4

(51) Int. Cl.
*B07B 11/06* (2006.01)
*B07B 7/08* (2006.01)
*B07B 7/083* (2006.01)

(52) U.S. Cl.
CPC ..... *B07B 7/083* (2013.01)

(58) Field of Classification Search
CPC ..... B07B 7/083; B07B 4/06; B01D 45/14
USPC ..... 209/295
See application file for complete search history.

(56) References Cited

U.S. PATENT DOCUMENTS 3,234,716 A * 2/1966 Sevin ..... B04B 5/08 210/360.1
3,727,383 A * 4/1973 Neitzel ..... B01D 45/14 55/337
4,799,595 A * 1/1989 Binder ..... B07B 7/083 209/135

FOREIGN PATENT DOCUMENTS

| | | | |
|---|---|---|---|
| DE | 899143 | C | 12/1953 |
| DE | 3814458 | A1 | 11/1989 |
| DE | 3826463 | A1 | 2/1990 |
| DE | 3508889 | C1 | 2/1992 |
| DE | 4429473 | A1 | 2/1995 |
| DE | 69302831 | | 7/1996 |
| DE | 19643042 | A1 | 4/1998 |
| DE | 102013101517 | A1 | 8/2014 |
| DE | 102015220269 | A1 | 4/2017 |
| EP | 818249 | A1 | 1/1998 |
| EP | 1004366 | A2 | 5/2000 |
| WO | 2008113339 | A2 | 9/2008 |

* cited by examiner

*Primary Examiner* — Joseph C Rodriguez
*Assistant Examiner* — Molly K Devine
(74) *Attorney, Agent, or Firm* — Whitmyer IP Group LLC

(57) ABSTRACT

A centrifugal separator including a separator housing and a separator wheel revolving in the housing. The separator housing has an inlet for material, a coarse material outlet, and a fine material outlet. The wheel is formed by a drum and a wheel shaft, which supports the drum and rotates around a horizontal axis. The circumferential jacket surface of the drum is interrupted such that it sets the material to be separated, which hits the drum on the outer jacket side, into rotation during operation and the separation air flows through it in the radially inwards direction. The fine material outlet is arranged on the end of the drum and fine material is discharged from the interior of the drum into the fine material outlet via the free front face of the drum. The wheel (Continued)

shaft consists of two parts, which are not directly connected to one another in a supporting manner.

20 Claims, 10 Drawing Sheets

CENTRIFUGAL SEPARATOR COMPRISING SPECIAL SEPARATOR WHEEL

TECHNICAL FIELD

The invention relates to a centrifugal separator.

BACKGROUND

Centrifugal separators are known in different embodiments in the prior art.

A separator drum revolving inside a drum-shaped separator chamber at high speed forms the centerpiece of every centrifugal separator.

The separator drum is perforated, interrupted or provided with a sieve structure on the jacket side in another way, respectively. Separation air is sucked in from the fine material outlet. A continuous separation air flow forms thereby. The latter enters into the separator chamber, usually together with the material to be separated, via the inlet for material to be separated. There, the separation air flow, which is loaded with the material to be separated, is swirled by the high-revving separator drum into a type of cyclone flow. The latter initially circles around the separator drum on the outside and finally enters through the perforated jacket of the separator drum into the interior thereof. From there, the separation air flow flows into the fine material outlet, which is adjacent to at least one front face of the separator wheel.

In the case of this process, the centrifugal separators take advantage of the fact that the larger particles of the material to be separated, which have more mass, are finally centrifuged to the outside by means of the centrifugal forces, when the material to be separated circles in the cyclone-like flow in the separator chamber. In contrast, smaller particles, which have a smaller mass and are thus only subjected to lower centrifugal forces at the same angular speed, are released from the cyclone-like flow by the separation air, which flows off to the inside, and are sucked into the interior of the separator drum, so as to then be discharged together with the separation air flow.

The market increasingly demands separators comprising an increased throughput, whereby the separation quality is to simultaneously also be increased or at least maintained, if possible.

One option for increasing the throughput of a generic centrifugal separator lies in increasing the diameter of the separator wheel and, associated therewith, in allowing the separator wheel to rotate at a higher speed because the mere increase of the separator wheel diameter at consistent nominal speed has the result that the obtainable fine material becomes coarser.

The speed increase has the result, however, that the systems become technically more complex, need to be balanced even more exactly, and require a more complex maintenance.

SUMMARY

The invention is dedicated to the problem of creating a centrifugal separator, which can be balanced more easily or better, respectively, and can be maintained more easily and provides the option of achieving a better quality of the separation.

According to the invention, the solution takes place by means of a centrifugal separator comprising the features of the first main claim.

It is a centrifugal separator comprising a separator housing which, as a rule, is stationary relative to the foundation and a separator wheel, which revolves in the separator housing. The separator housing has at least one inlet for material to be separated, at least one separation air inlet, at least one coarse material outlet, as well as at least one, usually a first and a second fine material outlet. Via the latter, the separation air, which is sucked in or fed in, respectively, at least via the inlet for material to be separated, is also removed, as a rule. The separation air is preferably pulled through the centrifugal separator by means of an external blower, which sucks in on the side of the fine material outlet.

The separator wheel is formed by a separator drum and a separator wheel shaft supporting the separator drum. Ideally, the separator wheel shaft rotates around an imaginary horizontal axis. The jacket surface of the separator drum is interrupted in such a way that it sets the material to be separated, which hits the separator drum on the outer jacket side, into rotation during operation, wherein further aids for creating the rotation can possibly be present. As a rule, it can be said that the material to be separated is set into rotation or is further accelerated, respectively, by the separator drum, among others. The material to be separated already has a certain translatory base speed upon entering into the machine, whereby the direction changes in this respect as part of the entering. The jacket surface of the separator drum is interrupted in such a way that the separation air flows through it in the radially inwards direction.

The fine material outlets are thereby arranged on the two front face ends of the separator drum, wherein fine material-separation air mixture flows out of the interior of the separator drum into the respective fine material outlet via the respective free front face of the separator drum. The same applies analogously, when only one fine material outlet is provided.

It is provided according to the invention that the separator wheel shaft consists of two parts, which are not directly connected to one another in a supporting manner. The first part of the separator wheel shaft thereby extends outwards from a first hub, which supports the separator drum in the area of its first front face, away from the separator drum. The second part of the separator wheel shaft extends outwards, in the opposite direction, from a second hub, which supports the separator drum in the area of its second front face, also away from the separator drum.

The following should initially be noted with regard to the conceptual clarification:

In terms of the invention, the term "not directly connected to one another" means that no direct power flow takes place from one into the other shaft part—in contrast to shaft parts, which are directly flanged to one another, sleeved or directly coupled to one another, e.g., by means of a serration. The two shaft parts are thus arranged at a spatial distance from one another. The separator drum is located between them. The distance between the two shaft parts is usually at least 80% of the length of the separator drum. The latter is self-supporting and bridges the distance between the two shaft parts in that it acts quasi as a hollow shaft there.

The term "fine material" in its broader sense inherently does not initially include a size limitation. The term "fine material", however, also has a narrower meaning—currently optionally—and then identifies such material of ultra-fine particles, in the case of which 98% of the particles have an average diameter of less than 6 μm and ideally even of less than 3 μm.

The embodiment according to the invention has the following consequences:

Due to the fact that a shaft, the imbalance of which is different from the imbalance of the separator drum, no longer revolves in the interior of the separator drum, the separator wheel can be fine-balanced easier and better. It is thus predestined for higher speeds and has less of a tendency to oscillate.

In addition, a significantly larger clear flow cross section is available for the mixture of separation air and fine material in the interior of the separator drum with the elimination of the separator wheel shaft, which centrally passes through. While the separation air, which is loaded with the fine material, enters with a speed of 13 to 17 m/s through the sieve structure of the separator roller into the interior thereof, the flow speed of the separation air, which is loaded with the fine material, slows down to 2 to 6 m/s directly in front of the fine material outlet due to the measure according to the invention. The tendency of the fine material to agglomerate, i.e. to clump, by swirls in the separation air is reduced thereby.

Moreover, the periodic maintenance of the separator wheel becomes much easier. A one-piece shaft no longer exists, which is extremely unwieldy due to its long length—in particular when it has to be manipulated in order to take or remove a one- or multi-piece separator drum and to slide on and position the replacement part again, so as to finally fix it by tightening a screw connection, which is located, often difficult to access, in the annular gap between the separator drum and the separator shaft.

In addition, the quality of the separation is usually also improved by means of the embodiment according to the invention, because the clear flow cross section inside the separator drum becomes larger. An effect, which is usually associated therewith, is that the transport of the fine particles is improved. After passing through the sieve-like drum jacket, the fine particles have more space in the interior of the separator drum, less agglomeration thus occurs after the separation.

Beyond the above statements, the invention is also dedicated to the problem of creating a centrifugal separator, which reaches a separating result, which is qualitatively further improved.

According to the invention, the solution takes place by means of a centrifugal separator comprising the features of the second main claim. On the one hand, independent protection is claimed for said centrifugal separator, without dependency on other claims. On the other hand, protection is also claimed for it in combination with the first main claim, thus turning it into a subclaim.

In its broadest form, the above-mentioned claim proposes a centrifugal separator as solution, in the case of which a one- or multi-piece guide member is arranged in the area of the at least one coarse material outlet. The guide member is arranged at a minimal distance X from the inner jacket surface of the separator housing section surrounding the separator drum. It is designed in such a way that material to be separated, which flows along said inner jacket surface at a radial distance <X, circumvents the guide member and is then centrifugally discharged into the coarse material outlet. The guide member is furthermore designed in such a way that at least a portion of the material to be separated, which flows along said inner jacket surface at a radial distance>X, is deflected in the radially inwards direction towards the separator drum, and thus approaches the separator wheel, usually more than only insignificantly.

For the conceptual clarification, the following should initially be noted:

The minimal distance X is measured in the radial direction. It identifies the distance, which the leading edge of the guide member, which the inflowing material to be separated reaches first, when it hits the guide member, holds from the inner jacket surface, which defines the separator chamber.

A circumventing in terms of the invention is present when material to be separated of the guide member passes on the radially outer side thereof, without receiving an impulse from the separator wheel, which changes or significantly changes the trajectory, respectively.

The embodiment according to the invention has the following consequences:

Material to be separated, which flows along said inner jacket surface at a radial distance <X, is coarse material, which has already separated as best as possible from the fine material and which is thus ready for separation from the separating process. It circumvents the guide member and reaches the coarse material outlet without interruption. Due to the fact that the support effect of the inner jacket surface is eliminated here, the arriving coarse material is then discharged into the coarse material outlet by means of the centrifugal forces acting on said coarse material. Due to the fact that the coarse material reaches the coarse material outlet on the slow-flow side, i.e. on the leeward side of the guide member, there is no risk that a portion of the coarse material is unintentionally carried back into the separator chamber again by means of swirls.

In contrast, the portion of the material to be separated, which flows along said inner jacket surface at a radial distance>X, is deflected in the direction of the separator drum 14 and is thrown back. It is prevented thereby that material to be separated, which has already come relatively close to the clear opening, which leads to the coarse material outlet, but which has nonetheless not yet qualitatively concluded the separating process, is prematurely discharged into the coarse material outlet by the centrifugal forces and the swirls occurring in the vicinity of said clear opening. This is so, because fine material, which can actually still be separated, would be removed from the separating process thereby, which would impair the separating result. Instead, a further separation of the material to be separated, which is thrown back in the direction towards the separator drum, takes place, as part of which the fine material, which is still being entrained by the coarse material so far, gets the chance to separate therefrom.

The guide member preferably partially covers the coarse material outlet or the clear cross section, respectively, which branches to the coarse material outlet. Preferably, more than 35% and more preferably even more than 50% of said clear cross sectional surface are covered.

The guide member provides the leeward area, which has already been mentioned above, with an extremely effective size in this way and it essentially prevents that material to be separated is prematurely discharged into the coarse material outlet takes place.

Constructions, in the case of which additional separation air, which flows off into the fine material outlet via the separator drum, is fed in on the coarse material outlet, are particularly preferred. This additional separation air could be referred to as support air acting in the area of the coarse material outlet, which—in particular in conjunction with said guide member—ensures that material to be separated is not prematurely discharged into the coarse material outlet. It is particularly preferred, when said separation air is not only sucked in passively, but is blown in actively by means of a corresponding blower or from a compressed air network.

It is favorable, when the ratio NL/ND between the useable length NL of the separator drum and the maximum useable diameter ND of the separator drum is >2 and ideally >2.3. If the optimal case of a NL/ND=2.5 is at hand, a separator drum, the useable length of which is 2.000 mm, has a useable diameter of 800 mm. The useable length of the separator drum is thereby the length, across which it extends freely through the separator chamber parallel to the axis of rotation L. The useable diameter is the maximum outer diameter of the drum. Fluidically insignificant structures, merely standing locally farther to the outside (e.g. flanges) are thereby not included in the calculation of the maximum outer diameter.

The throughput can be increased by the construction of a very long separator drum without increase of the nominal diameter thereof. This is so, because the passage surface, via which fine material can be sucked from the separator chamber into the interior of the separator drum, increases as the length increases. Due to the fact that the nominal diameter of the separator drum is not increased, the separating result is not negatively impacted. In particular, an increasing input of coarser grains into the obtained fine material, which has to be compensated by other measures, does not occur.

A separator drum, which is longer in the axial direction, with otherwise identical parameters (diameter, speed and air quantity) simultaneously tends to lead to a finer separation, because the radial passage speed of the air through the sieve-like jacket of the separator drum decreases due to the larger flow entry cross section. As a result of this, there is a tendency that only finer particles can be sucked in by overcoming the centrifugal forces acting thereon.

It is particularly favorable to embody the centrifugal separator in such a way that at least one, preferably both parts of the separator wheel shaft are mounted outside of the chamber of the material to be separated. The roller bearings arranged in the separator chamber itself until now had to be protected at great expense against the turbulent and thus highly invasive and abrasive atmosphere in the separator chamber. An arrangement outside of the separator chamber, e.g. in the area of the fine material outlet, which is flown through far less turbulently, brings an improvement here. The maximum improvement is reached, when the bearings are arranged completely outside of every fine dust-loaded atmosphere, thus also outside of the fine material outlet, easily accessible on the side thereof facing away from the separator chamber. Here, they reach significantly longer average service lives, which is a significant advantage in the case of high speeds.

It turned out to be particularly favorable, when blades protrude radially inwards from the inner jacket surface of the separator drum, which influence the movement of the separation air, in particular guide the separation air and intensify the rotation thereof. It is important to consider in this context that the rotation of the separation air in the interior of the separator drum reduces the pressure, which is necessary to convey the fine product in the direction of the outlets on the front face.

It is particularly favorable thereby, when the intermediate ring, which will be discussed in more detail later, which is in particular designated for the separator drum center, has blades of the mentioned type, which protrude radially to the inside from its inner jacket surface.

Ideally, support rings, which are closed in the circumferential direction, protrude radially to the inside from the inner jacket surface of the separator drum. The separator drum, which is often quite long and nonetheless comparatively thin-walled, is supported at certain intervals by such support rings, and is thus prevented from widening to the outside in a drum-like manner in the case of extremely high speeds, and from thereby possibly even being overloaded or even from failing.

It is particularly advantageous, when said support rings are formed in pairs of flanges protruding radially to the inside, by means of which the separator drum elements, which will be discussed in the next paragraph, are flanged to one another.

The separator drum preferably consists of a plurality of, preferably of at least four separator drum elements. They are arranged one behind the other along the joint axis of rotation and are connected to one another, preferably screwed to one another.

It is particularly favorable, when the plurality of separator drum elements consist of two groups of identical separator drum elements each, because the production costs can be lowered as a result of identical parts. A cost-efficient modularization can possibly even be attained for entire series, for instance in that larger centrifugal separators are equipped with one separator drum, which plurality of separator drum elements consist of two sets of two identical separator drum elements on the one hand and of three identical separator drum elements on the other hand, instead of two sets of two identical separator drum elements each.

Ideally, an intermediate ring is installed between two separator drum elements in the center of the separator drum. The intermediate ring has—preferably on its outer jacket surface—one or a plurality of depressions for receiving a balancing mass body, usually in the form of at least one balancing groove.

Such an additional support ring can support in particular the central area of the separator drum, which is particularly loaded by the centrifugal forces, highly effectively and can protect it against overload.

Another further development option of the invention is that the separator drum has a deflector lip on its front face ends, directly at the transition to the fine material outlet. Said deflector lip extends radially inwards at an incline—preferably at an angle of 35° to 50°. The deflector lip prevents that an unwanted separation air flow appears via the shortest route, almost in a type of "short-circuit", which, at the front face of the separator drum, flows directly from the jacket thereof into the fine material outlet. This is so, because such an unwanted separation air flow may drag only incompletely separated material to be separated into the fine material outlet and thus leads to a type of partial "short-circuit".

The wheel disks, which connect the separator drum to the separator wheel shaft, preferably consist of a rim, which is connected to a hub sleeve via at least two, preferably at least three spokes.

It is particularly favorable, when the rim forms an inner jacket surface, which widens conically towards the fine material outlet—namely not only in terms of a chamfer, which is common in mechanical engineering, but to at least 25%, preferably at least 45%, of the extension of the rim in the direction of the axis of rotation. The guidance of the separation air loaded with the fine material is improved thereby at the location, where it escapes from the front face of the separator drum into the fine material outlet at high speed. It is thus prevented that this leads to strong swirls as a result of an overly brusque change of the clear flow cross section or a brusque deflection, respectively, at an excessive flow speed. This is so, because swirls, which are too strong at this location, could have the result that a portion of the fine material, which is guided along by the separation air, which flows out, falls out prematurely and accumulates in an obstructive manner, instead of being completely discharged by the separation air, which flows out.

As part of a particularly preferred further development, it is provided that the length of the hub sleeve in the direction of the axis of rotation is greater than the length of the rim of the wheel disk. A particularly firm and rigid anchoring of the separator wheel shaft parts according to the invention, which does not tend to persistent oscillations or at least temporary imbalances (for instance when passing through the subcritical speed range during the startup). Ideally, the length of the hub sleeve in the direction of the axis of rotation is at least 30%, preferably at least 50% larger than the corresponding length of the rim.

Another, particularly favorable option is that the first and the second part of the separator wheel shaft each form a disk flange, which protrudes radially to the outside. This disk flange in each case preferably bears completely against the front ring surface of the hub sleeve assigned to this part of the separator wheel shaft facing the interior of the separator drum. The disk flange is preferably screwed to the hub sleeve, which not least ensures additional bending stiffness.

Further embodiment options, further technical effects, and further advantages result from the exemplary embodiment, which will be described below by means of the figures.

DETAILED DESCRIPTION

The general operating principle of a centrifugal separator, according to which the centrifugal separator according to the invention works as well, has already been described in the introductory description. To avoid repetitions, reference is made thereto.

Figure 1:
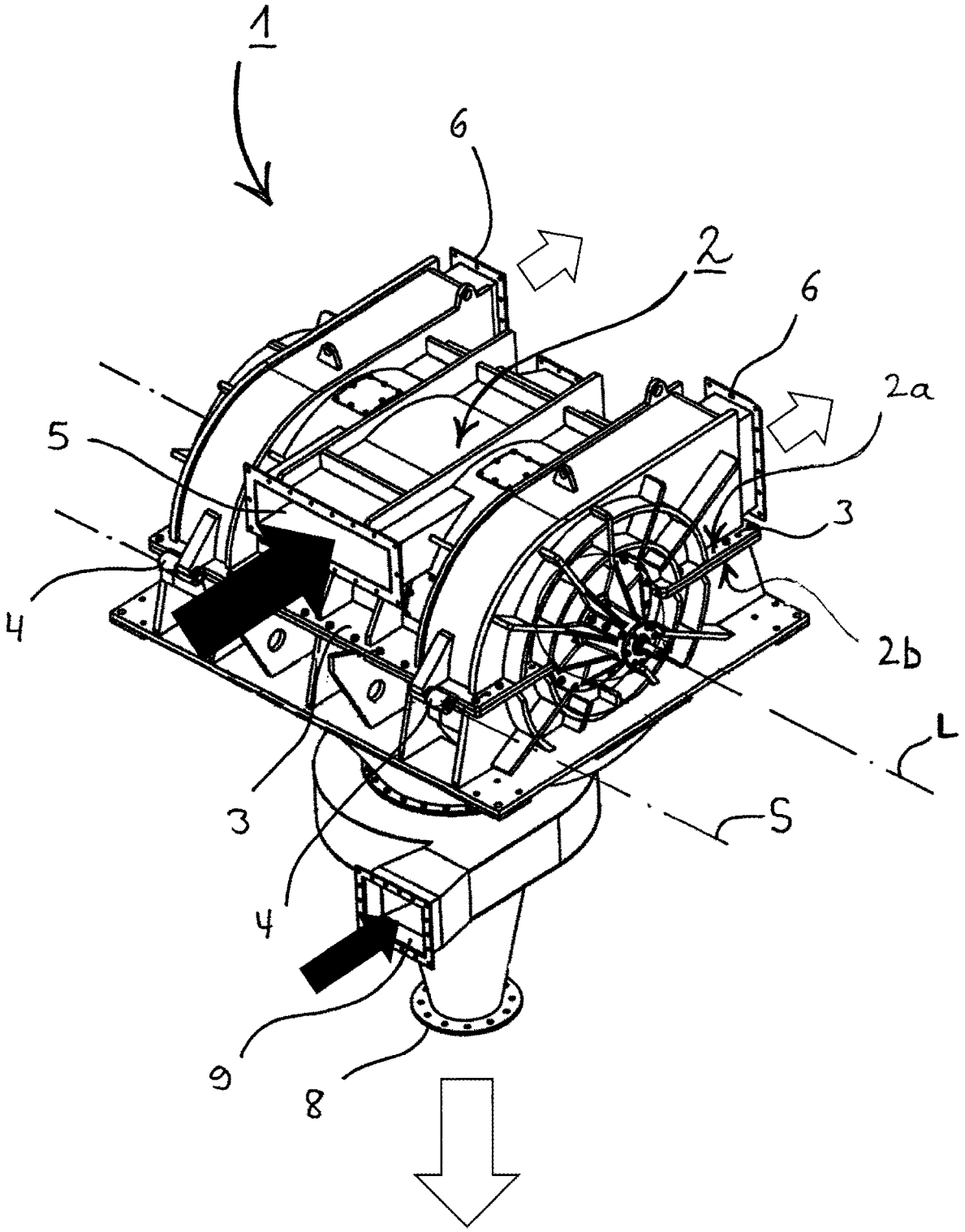
FIG. 1 shows a perspective view at an incline from the top and from the outside onto a centrifugal separator according to the invention.

FIG. 1 provides a first overview of a preferred exemplary embodiment of the centrifugal separator 1 according to the invention.

The separator housing 2 can be seen well here. A separator wheel, which is not shown by FIG. 1, rotates in it.

The separator housing 2 is preferably divided into a top part 2*a* and a bottom part 2*b* by a horizontal flange 3. The top part 2*a* can then preferably be released as a whole and can either be removed completely or can at least be folded open to the top by the hinges 4 and the hinge pivot axis S thereof. A simple maintenance access to the separator chamber is thus obtained, which should advantageously be cleaned regularly or, in the batch operation, after every batch.

A separator wheel, which will be described in more detail shortly, rotates around the axis of rotation L in the separator chamber 10, which the separator housing 2 defines in its interior. The separator wheel can be seen well in FIG. 3, it is identified with reference numeral 7 there.

As can be seen, the centrifugal separator is preferably embodied as horizontal separator. This means that the axis of rotation L, around which the separator wheel 7 revolves, runs horizontally in operational state.

The loading of the roller bearings, on which the separator wheel of this centrifugal separator is mounted in order to keep the separator wheel completely or essentially free from play, is reduced through this. This is significant in the case of the high speeds, to which the roller bearings are subjected, because the separator wheel preferably rotates at an outer circumferential speed of between 50 m/s and 150 m/s. The reason for this is that the roller bearings inherently essentially bear the same load on each side of the separator wheel with horizontally running axis of rotation L. In contrast, a consistent bearing load is more difficult to realize in response to a rotation of the separator wheel around an axis, which runs vertically.

Above the separator wheel, the separator housing 2 has an inlet 5 for material to be separated. The material to be separated of coarse and fine material, which is mixed with one another, is supplied to the separator chamber via this inlet 5 for material to be separated (large black arrow). As a rule, the inlet 5 for material to be separated simultaneously acts as separator inlet. At least the majority of the separation air thus also enters into the separator chamber via this inlet 5 for material to be separated. Due to the embodiment of the separator wheel according to the invention, which will be described in more detail below, which is particularly favorable from a fluidic aspect, it is possible for the first time as part of the invention to increase the product-to-air ratio. For separators according to the invention, it is ideally at least 0.5 kg, more preferably at least 0.75 kg of material to be separated per cubic meter of separation air. The optional upper limit is 1 kg of material to be separated per cubic meter of separation air. Said mixture of material to be separated and separation air preferably flows in essentially in the tangential direction. An entry oriented in this way supports the circling of the material to be separated, which creates the separating effect, in the separator chamber. As can be seen, the inlet 5 for material to be separated extends across the majority of the length of the separator chamber, viewed in the direction of the axis of rotation L.

On both front ends of the separator chamber, the separator housing 2 in each case has a fine material outlet 6. Via the latter, the fine material, which is completely separated, is discharged. As a rule, the discharge takes place with the help of the separation air, which is also removed via the fine material outlet 6. As can be seen, the fine material is preferably discharged in the tangential direction, which is symbolized by the two small white arrows.

The separator housing 2 has a coarse material outlet 8, which, as a rule, is arranged completely below the separator wheel 7. This coarse material outlet is symbolized by the large white arrow in FIG. 1.

A certain percentage of separation air is preferably additionally blown into the separator chamber via the coarse material outlet 8 or the auxiliary air supply 9 arranged there, respectively, by means of a blower, which is not figuratively illustrated. This auxiliary air supply is symbolized by the small black arrow in FIG. 1. In particular fine material, which has unintentionally fallen into the area of the coarse material outlet or which is at risk of unintentionally falling into this area, is transported back into the separator chamber. This leads to a significant improvement of the quality of the separating result.

Figure 2:
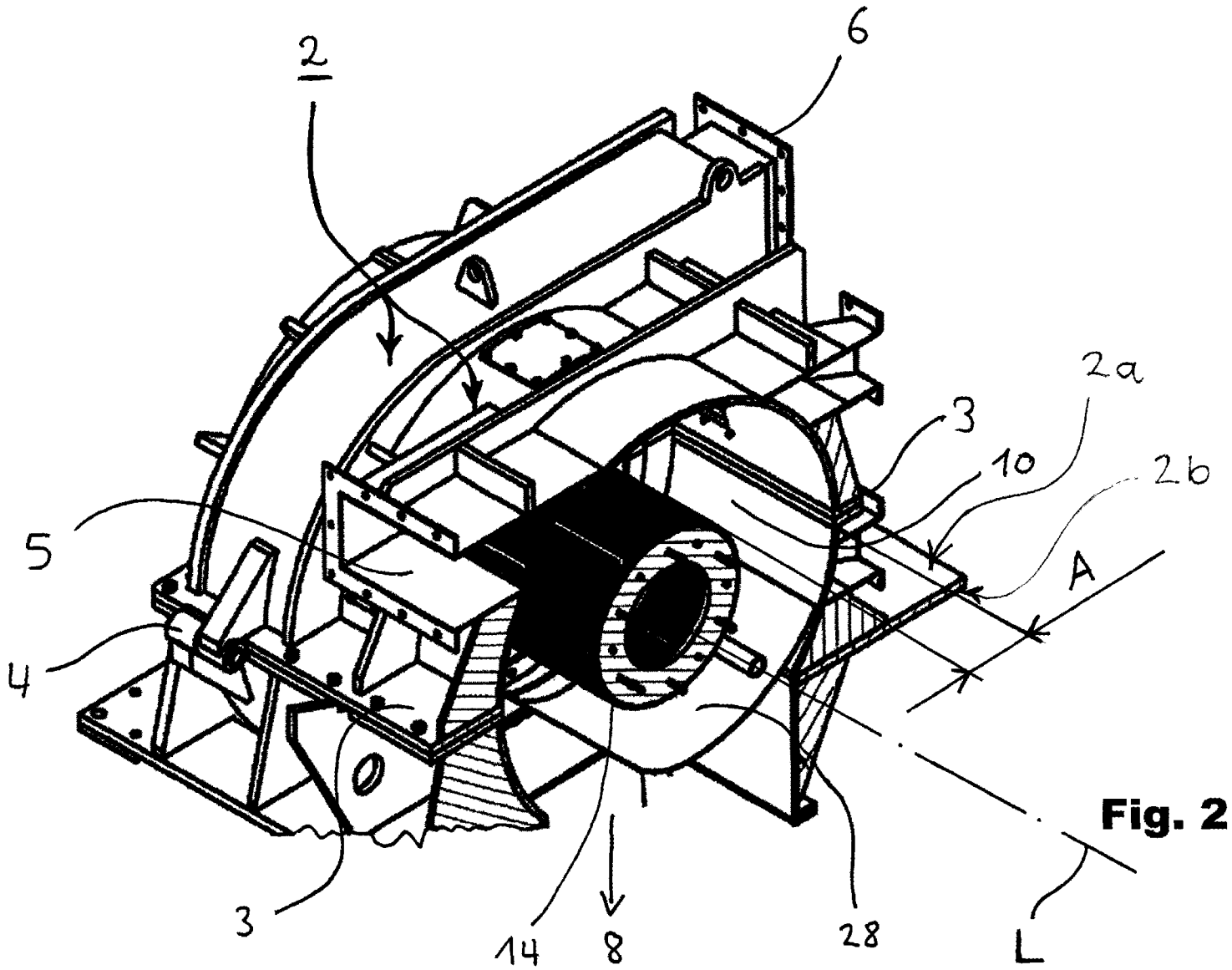
FIG. 2 shows a central longitudinal section perpendicular to the axis of rotation through the centrifugal separator according to FIG. 1.
Figure 3:
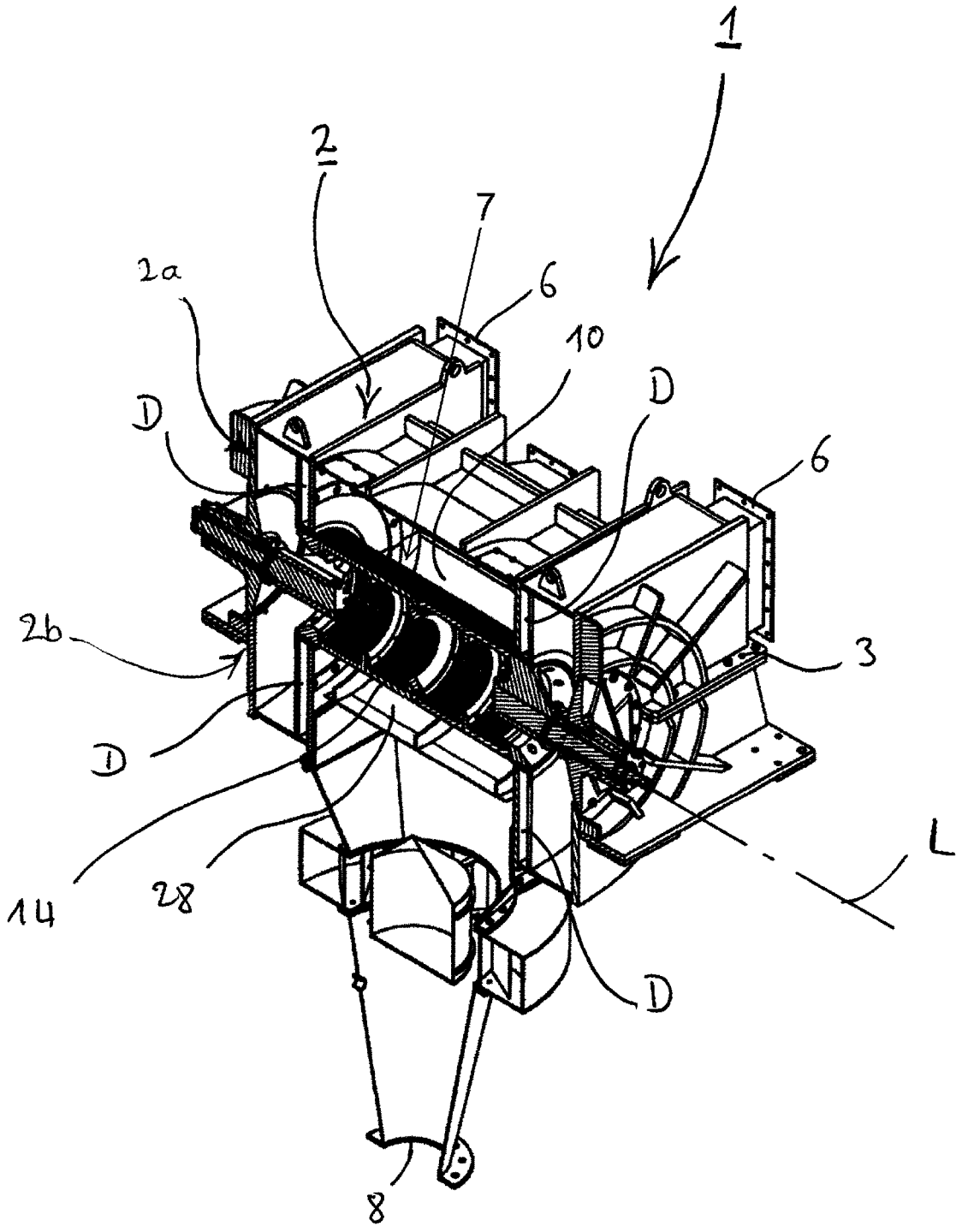
FIG. 3 shows a section along the axis of rotation through the centrifugal separator according to FIG. 1.
Figure 4:
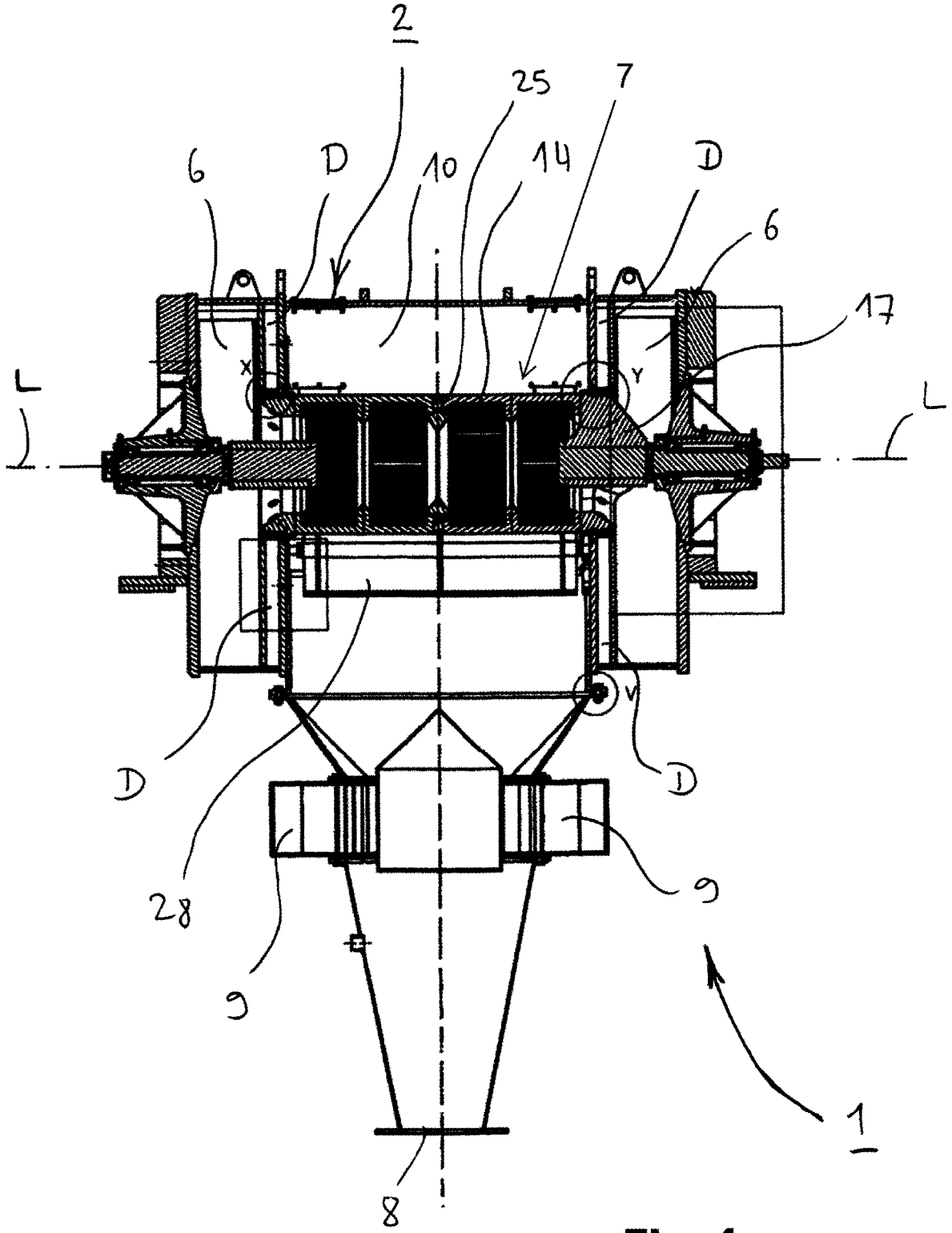
FIG. 4 shows a front view onto the sectional surface of FIG. 3.

Further details can be seen very well by means of FIG. 2, which shows a section in the vertical direction through the central area of the separator and which is to be seen in combination with FIG. 3.

The cut part of the inlet 5 for material to be separated, the fine material outlet 6 located downstream therefrom in the direction of the axis of rotation L, and the coarse material outlet 8 located on the bottom, into the clear opening of which the guide member 28 protrudes, can be seen well here. It can also be seen well, how the separator housing 2 embodies a separator chamber 10 in the form of an essentially cylindrical drum, which runs horizontally here. The separator wheel 7 rotates in this drum, at a considerable distance to the inner jacket surface A of the drum. The distance A is preferably between 25% and 65% of the outer diameter of the separator wheel 7.

In particularly preferred cases, it is between 32% and 40% of the outer diameter of the separator wheel 7.

Figure 6:
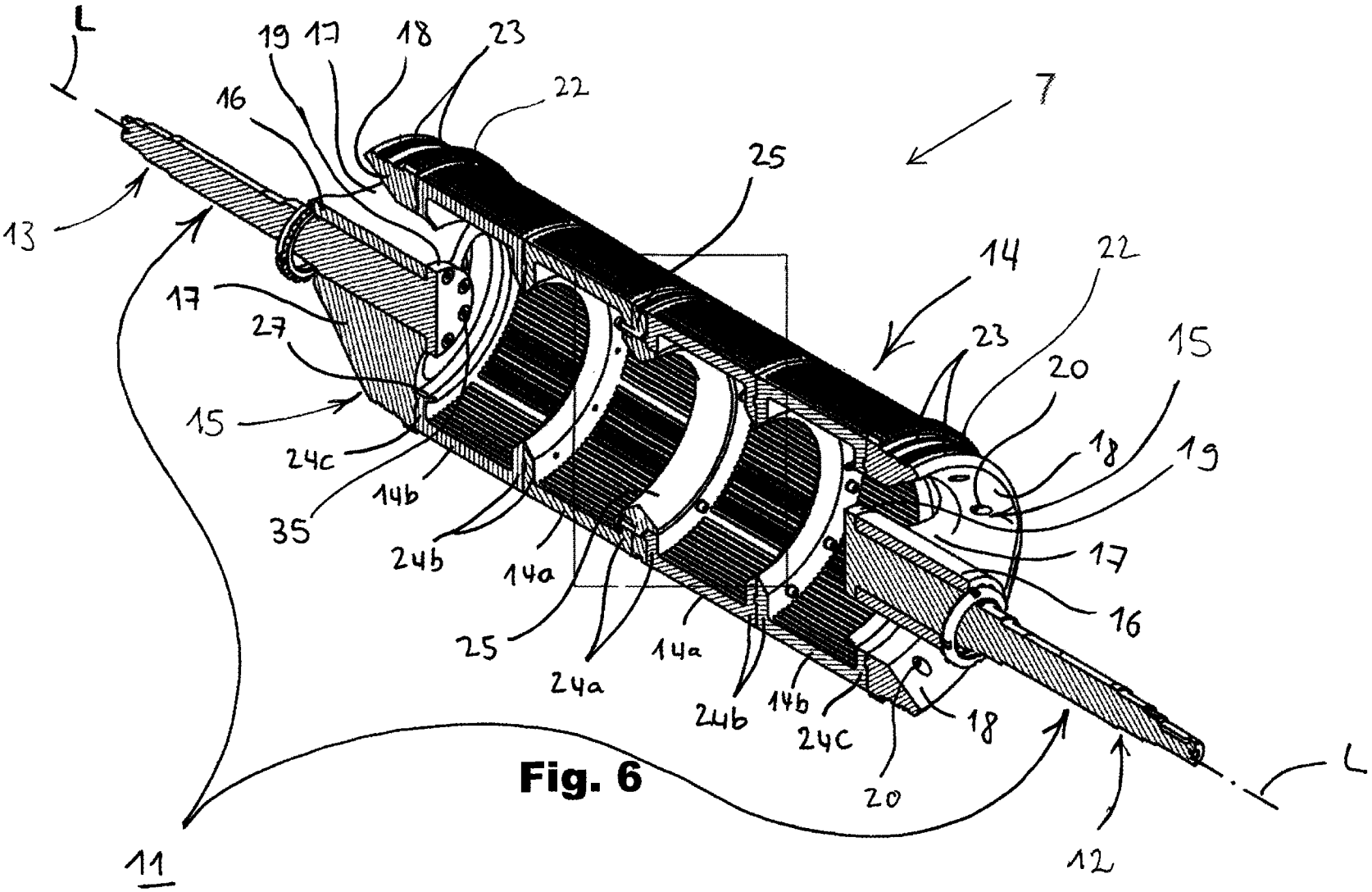
FIG. 6 shows an overall view of the centrifugal separator according to the invention.
Figure 7:
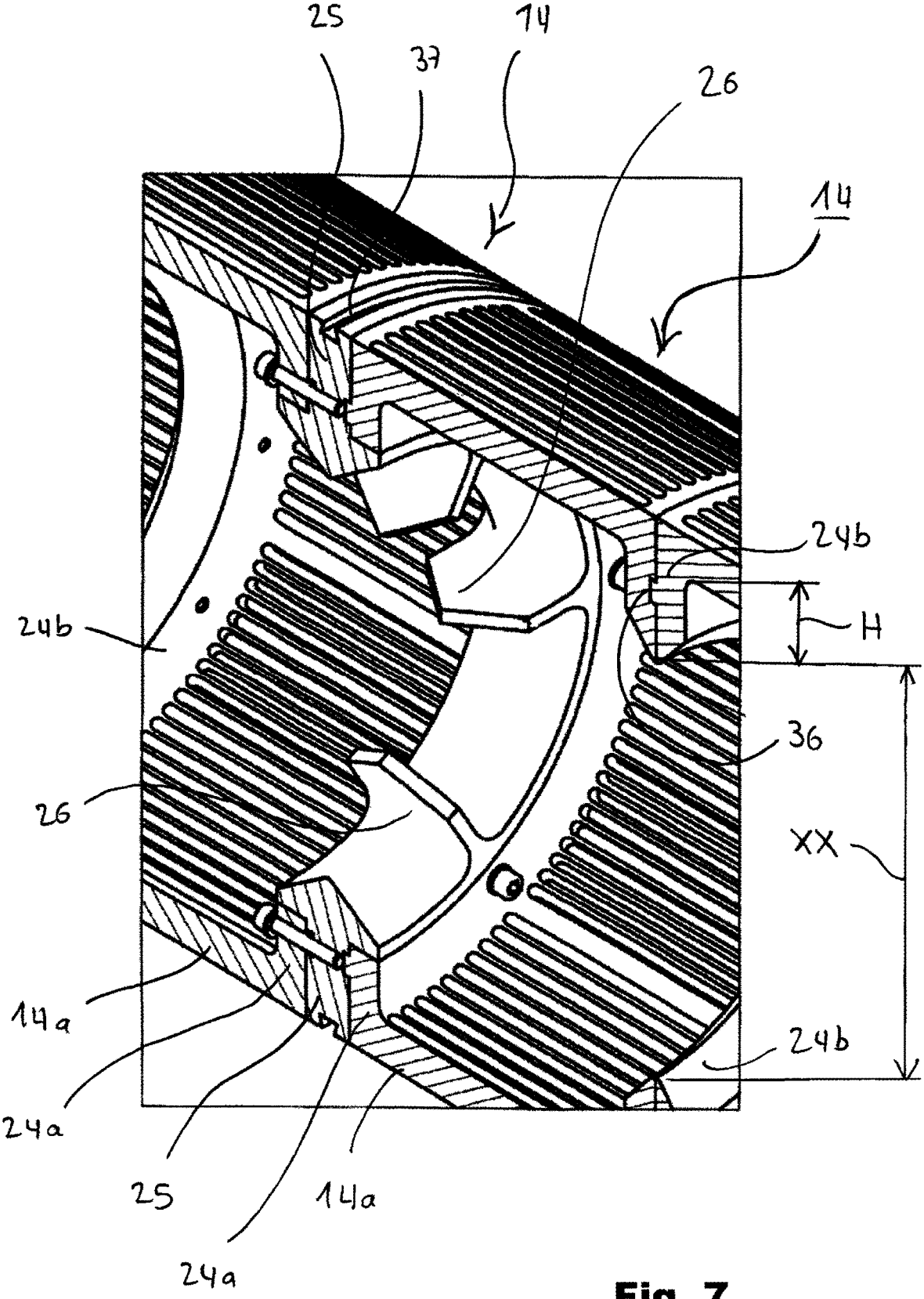
FIG. 7 shows a sectional enlargement from FIG. 2 in the central area, wherein, however, the intermediate ring is optionally equipped with blades here.

The separator wheel 7 according to the invention and its exact setup can best be described by means of FIGS. 6 and 7.

The separator wheel 7 essentially consists of a separator drum 14 comprising a separator wheel shaft 11, which forms the axis of rotation thereof.

As can be seen immediately by means of FIG. 6, the separator wheel shaft 11 is characterized in that it does not completely traverse the separator wheel 7. Instead, the interior of its separator drum 14 remains free from said separator wheel shaft, on at least 80% of its length, measured in the direction of the axis of rotation L. In this area, the separator drum 14 takes over the support function of the section of the separator wheel shaft 11 recessed here, which will be discussed in more detail shortly.

As can be seen, the separator wheel shaft 11 consists of a first and a second separator wheel shaft part 12, 13. The two separator wheel shaft parts each end in a wheel disk 15. This wheel disk 15 consists of a hub sleeve 16, which is connected to a rim 18 via at least three spokes 17, preferably in one piece. In the direction of the axis of rotation L, the hub sleeve 16 has a length, which is greater than the corresponding length of the rim 18.

As can be seen well, each separator wheel shaft part 12, 13 forms a disk flange 19 on its end, which faces the interior of the separator drum. This disk flange 19 bears against the inner front face of the hub sleeve 16 assigned to it. The respective disk flange 19 thus prevents that the respective separator wheel shaft part 12, 13 can be pulled out of the hub sleeve 16 to the outside. The disk flange 19 is preferably furthermore screwed to the hub sleeve 16. The bolt heads 35 of the corresponding, preferably at least six bolts, can be seen in FIG. 6 on the disk flange 19 of the first separator wheel shaft part 12.

As has already been mentioned briefly above, the separator drum 14 takes over the support function in that region, in which the separator wheel shaft 11 is exposed. For this purpose, the jacket surface of the separator drum is embodied to be thick-walled. Its wall thickness can correspond essentially to the wall thickness of a hub sleeve 16. It is particularly favorable, when its wall thickness is greater than 20 mm and ideally lies in the range of between 30 mm and 48 mm, +1-0.3 mm. The separator drum is additionally reinforced by means of the ring disk-shaped support rings, which protrude to the inside and of which a plurality are provided at a distance from one another on the inner surface of the separator wheel, and which will be discussed in more detail shortly. The majority of the circumferential jacket surface of the separator drum is interrupted. It then forms a sieve- or preferably grid-like or an interrupted structure, respectively, through which suction can take place. A grid-like structure can in particular be characterized in that its apertures in the direction parallel to the longitudinal axis are longer by at least the factor 7.5 and preferably by at least the factor 10, than in the circumferential direction, which can improve the suction characteristic.

Each separator wheel shaft part 12, 13 is preferably equipped as stepped shaft comprising different diameters. It is overlapped by the hub sleeve 16 preferably at the location, where said stepped shaft has its greatest diameter (except for the disk flange 19).

As can be seen, the rim 18 of the wheel disk 15 is embodied as ring, which completely closed in the circumferential direction. A front face of this ring bears against a corresponding front face of the separator drum 14 and is screwed thereto. The screw connection preferably takes place from the outer side of the wheel disk 15. The receiving bores 20 for the bolt head in the rim 18 can accordingly be seen here, see FIG. 6.

FIG. 6 shows, how the inner jacket surface 21 of the rim 18 widens conically towards the fine material outlet. This widening is more than only a chamfer, which is common in mechanical engineering. In the present case, it extends across the majority of the length of the rim in the direction of axis of rotation L.

On its outer circumferential surface, each rim supports a type of toothing 22 or other blade-like structures, respectively. Together with the housing surrounding them, they form a type of impeller and/or mechanical deflector, which is arranged in the flow direction upstream of the sealing gap, for which it is operatively responsible, see FIG. 6 in combination with FIG. 10. It keeps particles from nonetheless reaching into this space—in spite of the air flushing of the gap between rotor and housing.

On its outer circumferential surface, the rim is preferably provided with one or a plurality of sealing grooves 23, which form a part of the labyrinth-like seal, by means of which the separator wheel is sealed on its front faces with regard to the fine material outlet 6—which will be discussed in more detail later.

The preferred embodiment of the spokes 17 can be understood by means of the rear part of FIG. 6. The spokes 17 preferably extend in purely radial direction from the hub sleeve 16 to the rim 18. At that location, where the spoke 17 is connected to the hub sleeve 16, each spoke 17 is exactly as long as said hub sleeve, measured in the direction of the axis of rotation L. Each spoke 17 thereby tapers towards the rim 18. This means that, as a rule, each of the spokes protrudes into the interior of the separator drum 14 and protrudes beyond the rim 18 to the outside on its opposite side in the direction of the axis of rotation L. In this way, the spokes have a relatively large surface and can thus effectively contribute to getting the separation air to rotate.

The separator drum preferably consists of a plurality of separator drum elements 14*a* and 14*b*, which are manufactured separately. They are arranged one behind the other along the joint axis of rotation L and are connected to one another, preferably screw connected. Ideally, the separator drum elements have a "usable length (NL) to usable diameter (ND) ratio", which satisfies the following equation: NL/ND=0.5 to 0.8. The useable length thereby corresponds to the total extension parallel to the axis of rotation L. A separator drum element, which extends 500 mm along the axis of rotation L, then has a diameter of 1,000 mm.

It is particularly favorable, when each of the separator drum elements 14*a*, 14*b* in each case has a ring disk-shaped fastening flange 24*a*, 24*b*, 24*c* on both of its front faces. Said fastening flange extends in the radially inwards direction by an amount H, based on the inner jacket surface of the separator drum element, where ideally: H>30 mm, see FIG. 7, where the measure H is marked. Viewed from a different perspective, it can be said with regard to this that the free surface, which has to provide sufficient space through the clear diameter XX (see FIG. 7), as a function of the measure H, so that the flow speed falls below 30 m/sec here. It goes without saying that the construction has to nonetheless have sufficient mechanical strength.

Said fastening flange thus lies completely in the interior of the separator drum. It supports the screw connection, which fixes two adjacent separator drum elements to one another. It usually also forms a centering groove or a centering protrusion 36, respectively, which is complementary thereto, via the interaction of which adjacent separator drum elements are accurately positioned relative to one another. An exact illustration of such a centering groove and of a centering protrusion, which is identified with reference numeral 36, can be found in FIG. 7, on the right, in the center.

In the case of this exemplary embodiment, a pair of ring disk-shaped fastening flanges 24*a*, 24*b*, 24*c*, which are screwed to one another, each form one of the support rings, which has already been discussed briefly above. It is prevented by means of these support rings that the separator drum 14 expands in a barrel-shaped manner to the outside in its central area under the influence of the strong centrifugal forces causing the high operating speed, or that it is even overloaded and fails.

In accordance with FIG. 6, a special intermediate ring 25 is thereby installed between two separator drum elements 14*a* in the center of the separator drum. This intermediate ring 25 supports one or a plurality of depressions on its outer jacket surface for receiving a balancing mass body, preferably in the form of at least one balance groove 37, see FIG. 7.

This intermediate ring 25, together with the ring disk-shaped fastening flanges 24*a* blocked by the screw connection, furthermore realizes a wider and thus particularly highly loadable support ring of the type as already described above. This has a particularly favorable effect, because the location of the separator drum 14, which is loaded most by the centrifugal forces, is located here.

The intermediate ring 25 can optionally be equipped with blades 26, which start at said intermediate ring and protrude even farther inwards in the radial direction and which serve to move the separation air without disturbing the below-described pressure compensation, see FIG. 7.

In the case of earlier constructions, the separator drum had been supported in the area of today's intermediate ring 25 with a disk wheel comprising narrow apertures or swirling spokes by the separator shaft for strength reasons. In contrast, a significantly better compensation results in the case of the construction according to the invention across the maximum flow cross section thereof of the current pressure between the left half of the separator drum, which communicates with the first fine material outlet, and the right half of the separator drum, which communicates with the second fine material outlet located on the other side.

The low pressure pulsations in the interior of the separator drum attained thereby improve the separating result, already because fewer agglomerations are created.

As can be seen, the radially inward end of each fastening flange 24*a*, 24*b*, 24*c* is beveled across the entire width, for instance in the manner of a pent roof, as it is shown by FIG. 6. Due to this, two fastening flanges, which are screwed to one another, form a saddle roof-like configuration, which functionally represents a slide bevel for the material to be separated. It is reliably prevented thereby that a slightly heavier portion of the material to be separated permanently deposits at this location during operation and is held on location by means of the centrifugal forces as could be the case as a result of a missing slide bevel in the case of a surface running parallel to the axis of rotation L.

The radially inward end of the intermediate ring 25 is beveled in a saddle roof-like manner for the same reasons and, where present, the inner ends of the blades 26.

It can be seen well by means of FIG. 6 that the separator drum elements as a whole consist of two groups of identical separator drum elements each. As can be seen, the two separator drum elements 14*a*, which meet in the center of the separator drum 14, are of identical construction and both of the separator drum elements 14*b* closing the separator drum 14 to the outside are also of identical construction.

Finally, FIG. 6 shows that the separator drum, on its two front side ends, directly at the transition to the fine material outlet 6, has a deflector lip 27, which extends radially inwards and simultaneously at an incline in the direction of the center of the separator drum 14. Said deflector lip has the function mentioned in the introductory description.

It is worth considering embodying the separator drum elements 14*a* and 14*b* as cast parts, for example of spheroidal graphite iron, which are then subsequently precision-turned. The large number of the apertures in the outer jacket surface of the separator drum 14 can be produced particularly efficiently in this way. Regardless of whether the separator drum is embodied in one or several pieces, it applies that these apertures are required for the entry of the separator air into the interior of the separator drum. In the case of the one- or multi-piece separator drum, they are also preferably the sole or at least major means for getting the separation air entering the separator chamber and the material to be separated, which is supported by it, to circulate in the separator chamber in such a way that the centrifugal forces can develop their separating effect.

Figure 5:
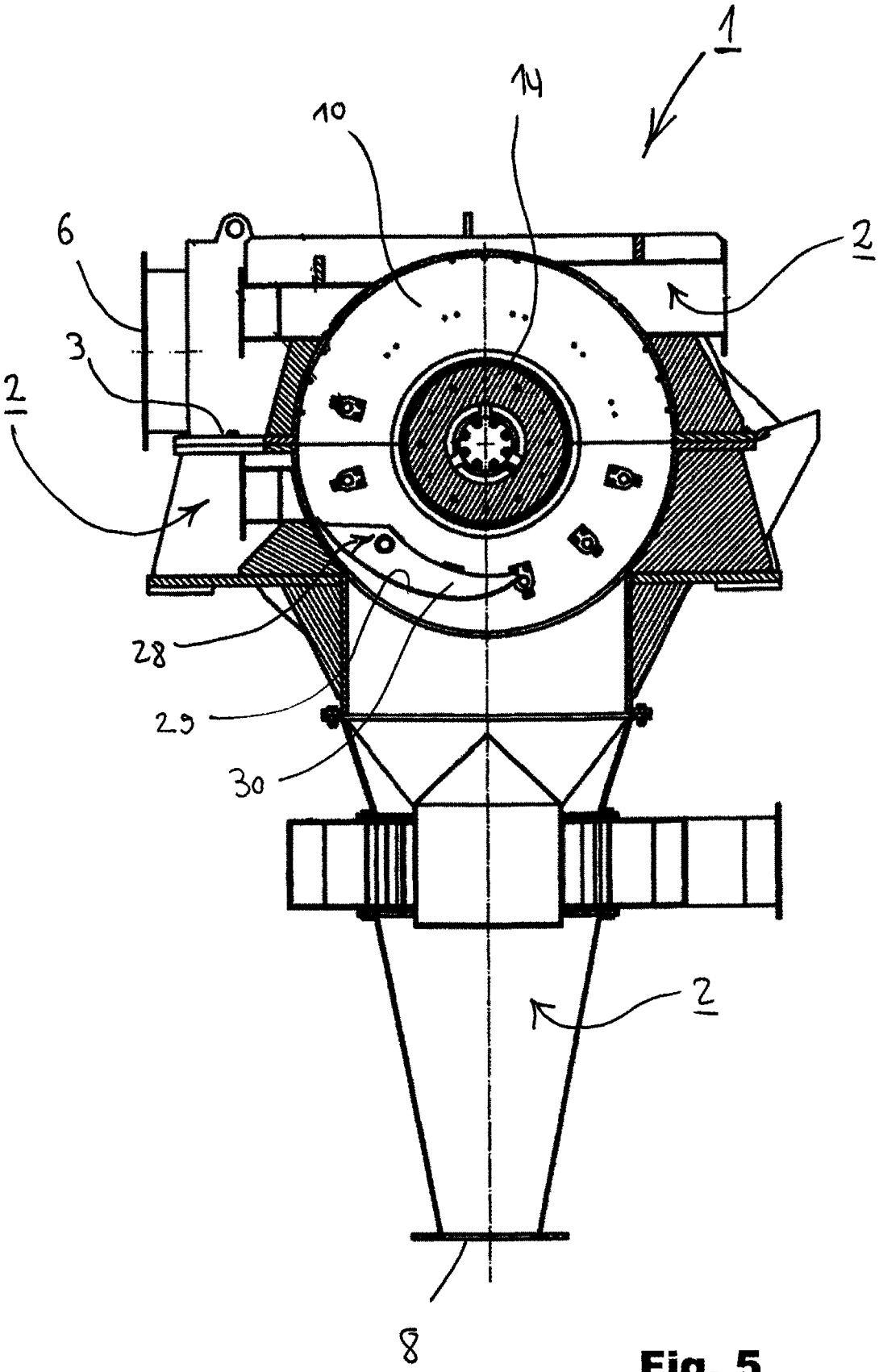
FIG. 5 shows a frontal view onto the sectional surface of FIG. 2.
Figure 8:
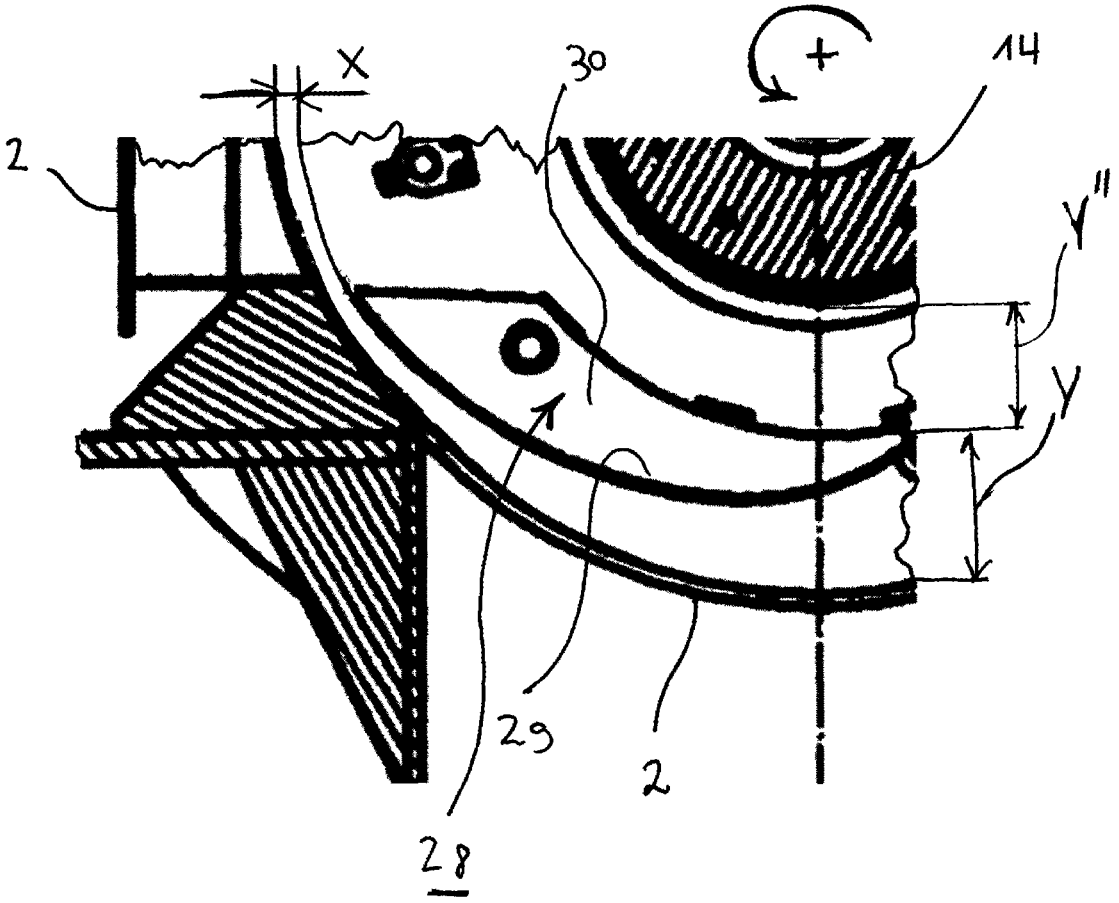
FIG. 8 shows a sectional enlargement from FIG. 5.
Figure 9:
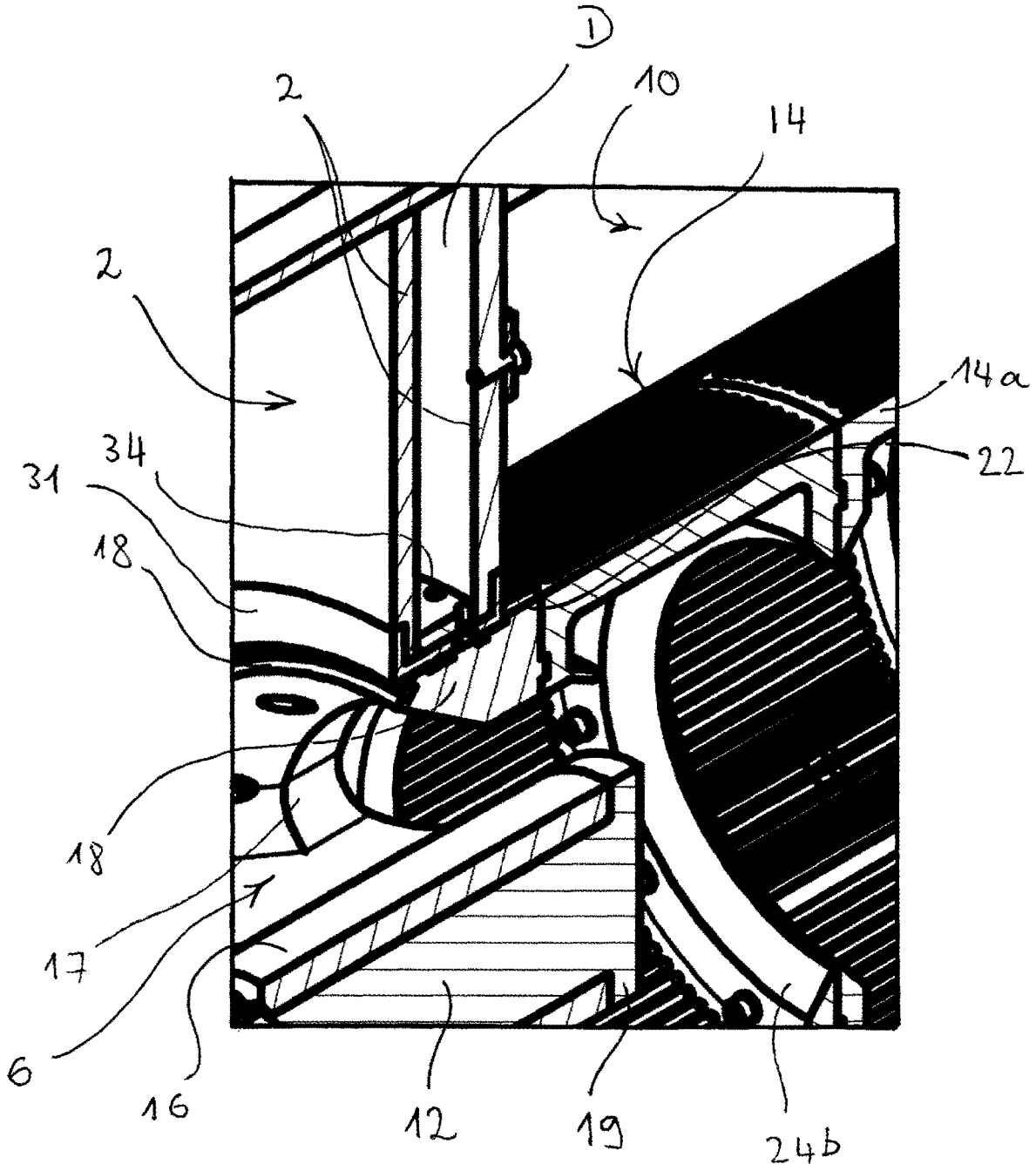
FIG. 9 shows what a seal according to the invention can look like, using a section.

The guide member 28 according to the invention, which controls the access to the coarse material outlet, can be recognized and described best by means of FIGS. 2, 5 and 8.

The guide member 28 according to the invention can be a blade or—in optional further interpretation of the term of the blade—a guide member, respectively, similar to a blade. The main guide surface 29 is thereof is curved in such a way that material to be separated, which hits this main guide surface 29 is deflected or thrown back, respectively, to the inside towards the separator drum 14. Fine material, which had so far possibly still been mixed to the material to be separated, which hits the blades 26, and had been entrained by it radially to the outside, thus gets the chance to nevertheless separate from the coarse material and to then be entrained by the separation air flowing off into the interior of the separator drum 14 and to be input into the interior of the separator drum 14. The classification quality is significantly improved thereby.

It is important to note that said curvature is preferably a steadily concave curvature, which is inclined towards the separator drum 14. The main guide surface 29 is preferably embodied as correspondingly curved sheet metal, which is held in shape by two edge sheets 30, which border it on both sides, see FIGS. 5 and 8. The main guide surface 29 is often also additionally stabilized in its center (measured in the direction along the axis of rotation L) by means of an edge sheet 30 of the mentioned type, which is welded on here as rib-like reinforcement. The blade is preferably designed in such a way that it does not cause any swirls—at least not any significant ones.

As a rule, the extension of the preferably one-piece guide member 28 according to the invention is so large in the direction parallel to the axis of rotation L that it covers the entire coarse material outlet in the direction along the axis of rotation L. Viewed in the direction of rotation, the extension of the guide member 28 according to the invention is preferably so large that the guide member covers more than 45% and preferably 60% to 70% of the clear area, with which the coarse material outlet leads into the inner jacket surface of the drum, which is embodied as part of the separator housing and which defines the separator chamber 10.

It is particularly favorable when the position of the guide member can be adjusted, ideally continuously, in and opposite the direction of rotation, so that it covers more or less of the clear area, as needed, with which the coarse material outlet leads into the inner jacket surface of said drum, which is not graphically illustrated separately here. The guide member according to the invention can be set to the maximum average grain diameters of the fine material currently required by the separator in this way.

The fact that the guide member 28 is attached at a distance X from the inner jacket surface of the drum, which defines the separator chamber 10, is thereby a special feature. The distance X referred to here is preferably between 3 mm and 12 mm. Ideally, it can be set, usually continuously. It applies in this context that the distance is a function of the number of coarse particles contained in the material to be separated. If many coarse particles are contained, separation must take place more quickly. There is a tendency that the distance is then set to be greater, so that a quicker expulsion results.

This positioning of the guide member 28 has the result that material to be separated (coarse material), which flows along said inner jacket surface at a radial distance <X, circumvents the guide member 28 and is then discharged into the coarse material outlet by means of the centrifugal forces. Only the portion of the material to be separated, which flows along said inner jacket surface at a radial distance >X and <Y, is deflected in the direction of the separator drum 14. For the distance Y, it thereby preferably applies that (DSK−DSR)/2, whereby DSK is the inner diameter of the separator chamber and DSR the outer diameter of the separator drum. In the alternative, it can be said that the distance Y" should lie in the range of between 1/2 DSR and 2/6 DSR.

It is also noteworthy that the guide member 28 is particularly effective in interaction with the auxiliary air supply 9, because these two improvements together develop a synergistic effect.

This can be seen quite well by means of FIG. 5.

The guide member 28 forces the auxiliary air, which is blown in via the auxiliary air supply 9, to enter into the separator chamber 10 so as to be oriented in the tangential direction to a greater extent. It prevents or reduces, respectively, the tendency of the auxiliary air to hit the separation air, which rotates in the separator chamber 10 at a high speed, at an obtuse angle in an unbraked manner and to thus produce unwanted swirls.

The guide member 28 simultaneously calms the air guide in the area, in which the coarse material settles, after it has circumvented the guide member 28. This is so, because the guide member 28 creates a leeward space, as compared to the separation air, which circulates in the separator chamber at a high speed, at least essentially.

All of this leads to a significant improvement of the separation quality.

As part of the invention, the focus is also on sealing the transition between the separator chamber 10 and the fine material outlet 6 at the front face of the separator drum 14 as effectively as possible. This is significant, because sealing errors at this location have the result that fine material, which has already been obtained with high separation quality, is contaminated with material to be separated, which has not yet been separated or not completely separated. This is to be avoided.

A contact-free seal is provided here for this purpose.

To be able to realize such a seal, the separator housing 2 is embodied as double-walled area in the area of the sealing location between the separator chamber 10 and the fine material outlet 6. This double-walled area is identified in FIG. 3 by reference numeral D.

Compressed air is guided towards the sealing location via this double-walled area D.

Figure 10:
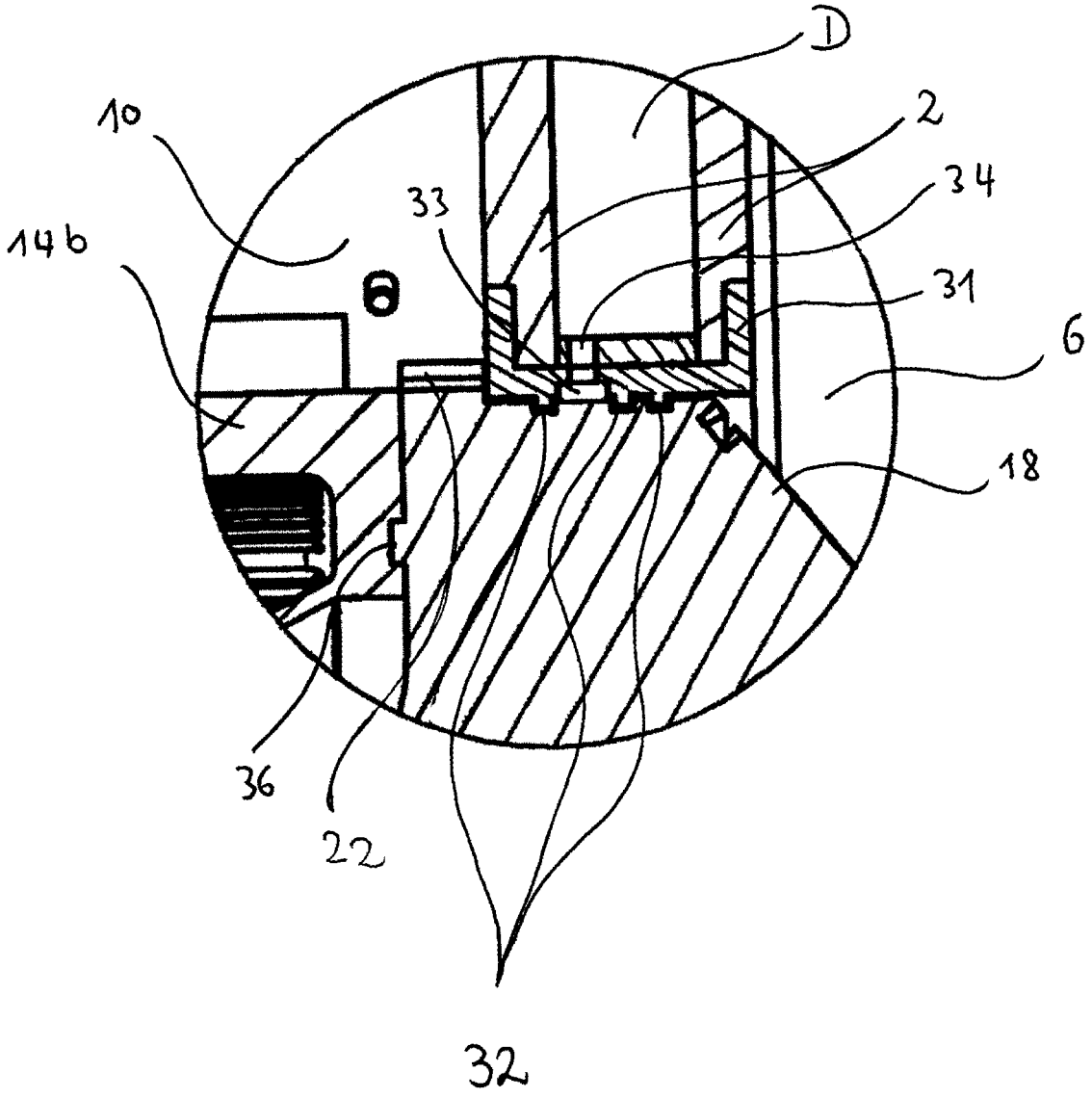
FIG. 10 shows the same as FIG. 9, frontally from the front.

FIG. 10 shows the actual sealing location in enlarged illustration. Initially, a section of the rim 18 can be seen here. On its outer side, it supports a plurality of, in the present case preferably three, circumferential sealing grooves 23, as they have already been discussed briefly above, see FIG. 6 once again.

On its end, close to the sealing location, the double-walled area supports a sealing insert 31, see FIG. 10 again. The sealing insert 31 is preferably embodied to be replaceable, even though the seal operates at least essentially in a contact-free manner, because, in the long run, it is in fact a wear part, in fine dust-loaded atmosphere. This sealing insert forms three raised, circumferential sealing rings 32.

Each of these sealing rings 32 engages with a sealing groove 23 assigned to it on the rim 18.

Due to the fact that the seal operates in a contact-free manner, the raised, circumferential sealing rings 32 and the sealing grooves 23 assigned to them form a type of labyrinth. To provide this seal with a real blocking effect, the sealing insert 31 is equipped with one or preferably a plurality of compressed air blow-in openings 34, via which compressed air is blown into the distribution channel 33 for said sealing labyrinth, which compressed air has been guided to the sealing location via the double-walled area, see FIG. 10.

From the distribution channel 33, the majority of the blown-in compressed air flows off into the separator chamber 10 and keeps the path, via which it flows out, free from penetrating material to be separated. The smaller portion of the blown-in compressed air flows off into the fine material outlet 6. The latter takes place because two baffles formed of sealing rings 32 and sealing grooves 23 stand in the way of said portion of the blown-in compressed air, and not only one, which is why the flow rate is accordingly lower.

Such a seal, which operates in a contact-free manner, is highly advantageous for the control of the high speeds appearing at the separator wheels according to the invention.

To avoid patent law-related circumventions, the same also applies analogously for centrifugal separators, which correspond to the claims, which have already been established, with the exception that they have a single fine material outlet only on one side, in particular when it is a vertical centrifugal separator.

Independent of, but also in combination with the claims, which have already been established, and/or features from the description the right is reserved to also claim protection for a centrifugal separator 1, which is characterized in that the separator wheel 7 is sealed in the area of its front faces on its outer circumference by a contact-free seal against the separator housing 2, into which blocking air is blown, which—preferably to a larger extent—flows out into the separator chamber 14 and—preferably—to a smaller extent into the fine material outlet 6.

Independent of, but also in combination with the claims, which have already been established, and/or features from the description the right is reserved to also claim protection for a centrifugal separator 1, the separator drum 14 of which, on its front face ends, directly at the transition to the fine material outlet 6, has a deflector lip 27, which extends radially inwards and simultaneously at an incline in the direction of the center of the axis of rotation of the separator drum 14.

Independent of, but also in combination with the claims, which have already been established, and/or features from the description the right is reserved to also claim protection for a centrifugal separator 1, in the case of which the length of a hub sleeve 16 for holding a separator wheel partial shaft 12, 13 in the direction of the axis of rotation L is greater than the length of the rim 18 of the wheel disk 15, which holds the separator drum in position.

The invention claimed is:

1. A centrifugal separator comprising a separator housing and a separator wheel, which revolves in the separator housing, wherein the separator housing has at least one inlet for material to be separated, at least one coarse material outlet, as well as at least one first fine material outlet, wherein the separator wheel is formed by a separator drum and a separator wheel shaft, which supports the separator drum and rotates around a horizontal axis, and a circumferential jacket surface of the separator drum is interrupted in such a way that it sets the material to be separated, which hits an outer jacket side of the separator drum, into rotation during operation and a separation air flows through it in the radially inwards direction, wherein the at least one fine material outlet is arranged on the end of the separator drum and fine material is discharged from the interior of the separator drum into the at least one fine material outlet via a free front face of the separator drum, wherein the separator wheel shaft consists of two parts, which are not directly connected to one another in a supporting manner, and the first part of the separator wheel shaft extends outwards from a first wheel disk, which supports the separator drum in an area of a first front face of the separator drum, away from the separator drum, and the second part of the separator wheel shaft extends outwards from a second wheel disk, which supports the separator drum in an area of a second front face of the separator drum, away from the separator drum.

2. The centrifugal separator according to claim 1, wherein a guide member is arranged proximate to the at least one coarse material outlet, wherein the guide member is arranged at a distance X from an inner jacket surface of the separator housing section, which surrounds the separator drum, and is designed in such a way that material to be separated, which flows along said inner jacket surface at a radial distance <X, circumvents the guide member and is then discharged into the coarse material outlet, and material to be separated, which flows along said inner jacket surface at a radial distance >X, is deflected in the radially inwards direction towards the separator drum.

3. The centrifugal separator according to claim 2, wherein the guide member covers at least part of the coarse material outlet in the flow direction.

4. The centrifugal separator according to claim 3, wherein the guide member covers more than 35% of the coarse material outlet in the flow direction.

5. The centrifugal separator according to claim 3, wherein the guide member covers more than 50% of the coarse material outlet in the flow direction.

6. The centrifugal separator according to claim 1, wherein the separator housing has a separator chamber, at least one of parts of the separator wheel shaft is mounted outside of the separator chamber, wherein the second part of the separator wheel shaft also engage through the respective fine material outlet and are only mounted outside of the fine material outlet, on the side thereof facing away from the separator chamber.

7. The centrifugal separator according to claim 1, wherein the at least one coarse material outlet is arranged below the separator drum and separation air, which flows off via the separator drum, is fed in on the coarse material outlet.

8. The centrifugal separator according to claim 1, wherein the ratio NL/ND between the useable length of the separator drum and the maximum useable outer diameter of the separator drum is >2.

9. The centrifugal separator according to claim 8, wherein the ratio NL/ND between the useable length of the separator drum and the maximum useable outer diameter of the separator drum is >2.3.

10. The centrifugal separator according to claim 1, wherein blades protrude radially inwards from an inner jacket surface of the separator drum.

11. The centrifugal separator according to claim 1, wherein support rings, which are closed in the circumferential direction, protrude radially to the inside from an inner jacket surface of the separator drum.

12. The centrifugal separator according to claim 1, wherein the separator drums consists of a plurality of separator drum elements, which are arranged one behind the other along the joint axis of rotation and are connected to one another, wherein the plurality of separator drum elements consist of two groups of identical separator drum elements each.

13. The centrifugal separator according to claim 12, wherein each separator drum element has a ring disk-shaped fastening flange on each front face of the separator drum element, which fastening flange extends in the radially inwards direction by an amount, based on an inner jacket surface of the separator drum element, whereby at least one fastening flange of each separator drum element is beveled across at least 25% of radial extension.

14. The centrifugal separator according to claim 1, wherein the wheel disks each consist of a rim, which is connected to a hub sleeve via at least two spokes, wherein the rim forms an inner jacket surface, which widens conically towards the fine material outlet.

15. The centrifugal separator according to claim 14, wherein the first and the second part of the separator wheel shaft each form a disk flange, which protrudes radially to the outside and which bears against a front ring surface of the hub sleeve assigned to this part of the separator wheel shaft facing the interior of the separator drum and is screwed to the hub sleeve.

16. The centrifugal separator according to claim 1, wherein the nominal speed of the separator drum reaches or exceeds 160 m/s on the outer diameter of the separator drum.

17. A centrifugal separator comprising a separator housing and a separator wheel, which revolves in the separator housing, wherein the separator housing has at least one inlet for material to be separated, at least one coarse material outlet, as well as at least one first fine material outlet, wherein the separator wheel is formed by a separator drum and a separator wheel shaft, which supports the separator drum and rotates around a horizontal axis, and a circumferential jacket surface of the separator drum is interrupted in such a way that it sets the material to be separated, which hits an outer jacket side of the separator drum, into rotation during operation and a separation air flows through it in the radially inwards direction, wherein the at least one fine material outlet is arranged on the end of the separator drum and fine material is discharged from the interior of the separator drum into the at least one fine material outlet via a free front face of the separator drum, wherein the separator wheel shaft consists of two parts, which are not directly connected to one another in a supporting manner, and the first part of the separator wheel shaft extends outwards from a first wheel disk, which supports the separator drum in an area of a first front face of the separator drum, away from the separator drum, and the second part of the separator wheel shaft extends outwards from a second wheel disk, which supports the separator drum in an area of a second front face of a separator drum, away from the separator drum, wherein the separator drum consists of a plurality of separator drum elements, which are arranged one behind the other along the joint axis of rotation and are connected to one another, wherein the plurality of separator drum elements consist of two groups of identical separator drum elements each, wherein an intermediate ring is installed between two separator drum elements in the center of the separator drum, wherein the intermediate ring has one or a plurality of depressions for receiving a balancing mass body.

18. The centrifugal separator according to claim 17, wherein the intermediate ring has blades, which protrude radially inwards from an inner jacket surface of the intermediate ring, wherein a ratio NL/ND between the useable length of the separator drum and the maximum useable outer diameter of the separator drum is >2.

19. A centrifugal separator comprising a separator housing and a separator wheel, which revolves in the separator housing, wherein the separator housing has at least one inlet for material to be separated, at least one coarse material outlet, as well as at least one first fine material outlet, wherein the separator wheel is formed by a separator drum and a separator wheel shaft, which supports the separator drum and rotates around a horizontal axis, and a circumferential jacket surface of the separator drum is interrupted in such a way that it sets the material to be separated, which hits an outer jacket side of the separator drum, into rotation during operation and a separation air flows through it in the radially inwards direction, wherein the at least one fine material outlet is arranged on the end of the separator drum and fine material is discharged from the interior of the separator drum into the at least one fine material outlet via a free front face of the separator drum, wherein the separator wheel shaft consists of two parts, which are not directly connected to one another in a supporting manner, and the first part of the separator wheel shaft extends outwards from a first wheel disk, which supports the separator drum in an area of a first front face of the separator drum, away from the separator drum, and the second part of the separator wheel shaft extends outwards from a second wheel disk, which supports the separator drum in an area of a second front face of the separator drum, away from the separator drum, wherein a guide member is arranged adjacent to the at least one coarse material outlet, wherein the guide member is arranged at a distance X from an inner jacket surface of the separator housing section, which surrounds the separator drum, and is designed in such a way that material to be separated, which flows along said inner jacket surface at a radial distance <X, circumvents the guide member and is then discharged into the coarse material outlet, and material to be separated, which flows along said inner jacket surface at a radial distance >X, is deflected in the radially inwards direction towards the separator drum, wherein the guide member covers at least part of the coarse material outlet in the flow direction, wherein the degree of coverage of the coarse material outlet by the guide member is adjustable.

20. The centrifugal separator according to claim 19, wherein the degree of coverage of the coarse material outlet can be adjusted continuously.

* * * * *